US005239778A

United States Patent [19]

Towler

[11] Patent Number: 5,239,778

[45] Date of Patent: Aug. 31, 1993

[54] MODULAR DOOR CONTROL APPARATUS WITH QUICK RELEASE CONNECTION

[75] Inventor: Harold Towler, Oklahoma City, Okla.

[73] Assignee: MTH Industries, Chicago, Ill.

[21] Appl. No.: 856,659

[22] Filed: Mar. 24, 1992

[51] Int. Cl.[5] ..... E05F 11/24

[52] U.S. Cl. ..... 49/339; 16/58; 92/130 C

[58] Field of Search ..... 49/339, 340; 16/58, 16/62, DIG. 21; 92/129, 130 C

[56] References Cited

U.S. PATENT DOCUMENTS

| | | | |
|---|---|---|---|
| 1,770,250 | 7/1930 | Norton | 16/62 |
| 1,895,895 | 1/1933 | Norton . | |
| 3,042,957 | 7/1962 | Muessel et al. | 16/62 |
| 3,259,937 | 7/1966 | Kotikov | 16/58 |
| 3,396,424 | 8/1968 | Russell et al. | 16/62 |
| 4,378,612 | 4/1983 | Beers | 16/62 |
| 4,414,703 | 11/1983 | Schnarr et al. | 16/62 |
| 4,506,407 | 3/1985 | Downey . | |
| 4,660,250 | 4/1987 | Tillman et al. | 16/58 |
| 4,793,023 | 12/1988 | Simpson et al. | 16/62 |
| 4,878,265 | 11/1989 | Nesbitt . | |
| 4,967,444 | 11/1990 | Körling et al. . | |
| 5,016,317 | 5/1991 | Hung | 16/58 |

FOREIGN PATENT DOCUMENTS

| | | | |
|---|---|---|---|
| 1588519 | 4/1981 | United Kingdom | 16/62 |

*Primary Examiner*—Peter M. Cuomo
*Assistant Examiner*—Michael Milano
*Attorney, Agent, or Firm*—Lockwood, Alex, FitzGibbon & Cummings

[57] ABSTRACT

A quick release door closer including a hydraulic assembly and a spring assembly connected at a quick release connection. The quick release connection includes a retaining element and element housing structured to allow the door closer to be easily maintained and, if necessary, the hydraulic assembly to be easily removed and replaced.

16 Claims, 2 Drawing Sheets

MODULAR DOOR CONTROL APPARATUS WITH QUICK RELEASE CONNECTION

BACKGROUND AND SUMMARY OF THE INVENTION

This invention generally relates to a door closing apparatus, and more particularly, relates to a door closing apparatus having modular characteristics in that a self-contained hydraulic damping assembly thereof is selectively releasably connected to a closing spring assembly.

Door operators or control devices are commonly used to regulate or control the closing cycle of a door. A door operator may simply consist of a spring which interconnects the door through a portion of the door frame. The spring is mounted within the door or an extension thereof in a manner such that the spring is compressed between a pair of spring blocks when the door is opened. When the opened door is released, the spring, in accordance with its spring constant, exerts a closing force on the door. The closing force may be selected in advance to match the characteristics of the door by selecting a desired spring constant.

Often, the spring may exert too strong of a closing force upon the door. To regulate the closing force, a damping assembly is typically used and made a part of the spring closing assembly to provide a means to dampen, or regulate, the closing force exerted on the door by the spring and slow down the rate of closure of the door. A door closing apparatus using both a damping assembly and spring assembly is referred to as a "combination" door operator or control device. The damping force prevents the door from closing too quickly an inadvertently catching persons between it and the door frame, or from the door causing any damage to door frame.

A typical hydraulic damping mechanism used in a door control apparatus includes a piston which reciprocates within a cylinder disposed within a housing of the door control apparatus. The piston reciprocates within the cylinder to displace fluid in and out of the cylinder into a nearby fluid reservoir in accordance with the movement of the door. The incompressible nature of the fluid acts to dampen the closing force applied to the door by spring. Combination door operators which utilize a spring closing mechanism and a hydraulic damping mechanism are commonly made as a one-piece structure. In instances where the hydraulic component fails, the fluid leaks past seal assemblies. The leakage of fluid not only may stain either the door frame or individuals using the door, but also renders the door control apparatus useless in that the hydraulic component can no longer dampen the closing force of the door. Whenever the hydraulic assembly or the spring assembly fails in a combination door operator in which the hydraulic component is integrated into the operator, such a failure necessitates that the entire door control apparatus be removed from the door and replaced. Because the mechanical components of the door control apparatus, such as the closing spring and any gear mechanisms associated therewith, may last virtually indefinitely when compared to the hydraulic damping component, the removal and replacement of the entire door control apparatus is wasteful and expensive.

A need therefore exists for a combined door control apparatus which is modular in nature and allows the easy removal and replacement of the hydraulic damping components(s) alone from the apparatus. The present invention is thus directed to a door control apparatus which overcomes the aforementioned disadvantages and permits the hydraulic assembly of the combined door control apparatus to be easily removed as a unit from the control apparatus.

In this regard, a door control apparatus constructed in accordance with the principles of the present invention utilizes a closing spring assembly and a hydraulic damping assembly that are operatively, and selectively releasably connected at a quick release connection point, to give the door control apparatus a modular nature. The hydraulic assembly has a self-contained construction which includes a fluid cylinder and a piston reciprocatably mounted therein. A fluid reservoir is disposed proximate to the cylinder and communicates therewith by way of a plurality of fluid transfer passages. The rod of the piston extends out of the cylinder and includes an engagement member which is received by a receptacle which adjoins one of the spring blocks. Such a quick release connection may include a ball-and socket-joint in which the ball member extends from the piston rod into the socket member which is either contained within the spring block or adjacent thereto. The spring assembly may be a conventional assembly and include a rack and pinion gear assembly interconnected to a spring retained in place between and compressible between two opposing spring blocks.

Accordingly, it is an object of the present invention to provide an improved combined door control apparatus.

It is another object of the present invention to provide a combination door operator having a modular construction in which a separate spring assembly and a separate hydraulic damping assembly are selectively releaseably interconnected with each other, the interconnection permitting the damping assembly to be disconnected from the spring assembly and removed as a single unit from the door control apparatus in a reliable manner and in a minimum amount of time.

Still another object of the present invention is to provide a door control device operator for a balanced door in which the control device includes a spring-biased closing assembly operatively and selectively releaseably engaged to a damping assembly, the damping assembly having a fluid-filled cylinder, a piston slidably disposed therein and a fluid reservoir communicating with the cylinder by way of multiple fluid transfer ports extending between a wall separating the cylinder from the reservoir, the fluid transfer ports being aligned along a longitudinal axis of the fluid piston, each of the ports having means for adjusting the size of the ports so as to control the rate of fluid flow between the fluid reservoir and the fluid cylinder, the damping assembly being further contained within its own housing, a portion of the piston extending through the damping housing, the piston operatively engaging the spring assembly at a quick release connection, whereby the damping assembly can be inserted into and removed from the door control apparatus as a unit.

These and other objects and advantages of the present invention will be clearly understood through a consideration of the following detailed description wherein like reference numerals refer to like parts.

BRIEF DESCRIPTION OF THE DRAWINGS

In the course of this detailed description reference will be frequently made to the following drawings in which.

DETAILED DESCRIPTION OF THE PRESENT INVENTION

Figure 1:
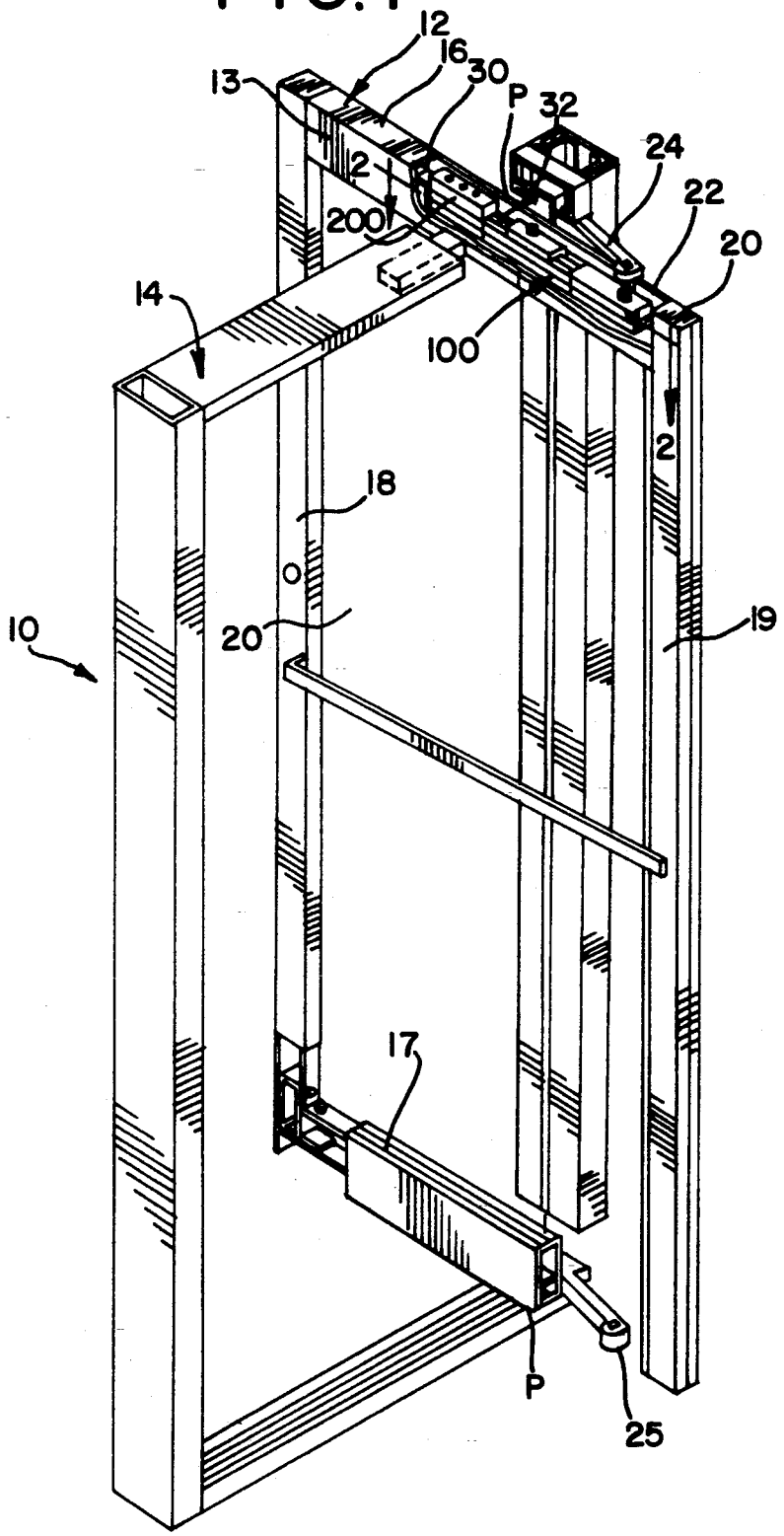
FIG. 1 is perspective view, partially in section, of a door utilizing a door control apparatus constructed in accordance with the principles of the present invention.

FIG. 1 illustrates a balanced door assembly 10 which utilizes a door control apparatus generally indicated as 100, constructed in accordance with the principles of the present invention. The door assembly 10 includes a door 12 pivotally retained within a surrounding door frame member 14. The door 12 is defined by pair of top and bottom horizontal rail portions 16, 17 interconnected by opposing vertical stile portions 18, 19. A glass door panel 20 is shown as contained within the door rail and stile portions 16–19. The door 12 illustrated is a "balanced" door, that is, the pivot point P where the door 12 is pivotally interconnected to the door frame 14 is located along the rail portions 16, 17 of the door rather than at the stile 19 of the door 12. The placement of this pivot point P inwardly along the rails 16, 17 away from the door stile 19 reduces the force required to open the door 12, than if the pivot point P were located at the door end 20. In FIG. 1, the door 12 is illustrated as opening from left t right.

Figures 2, 3, 4, 5, 6:
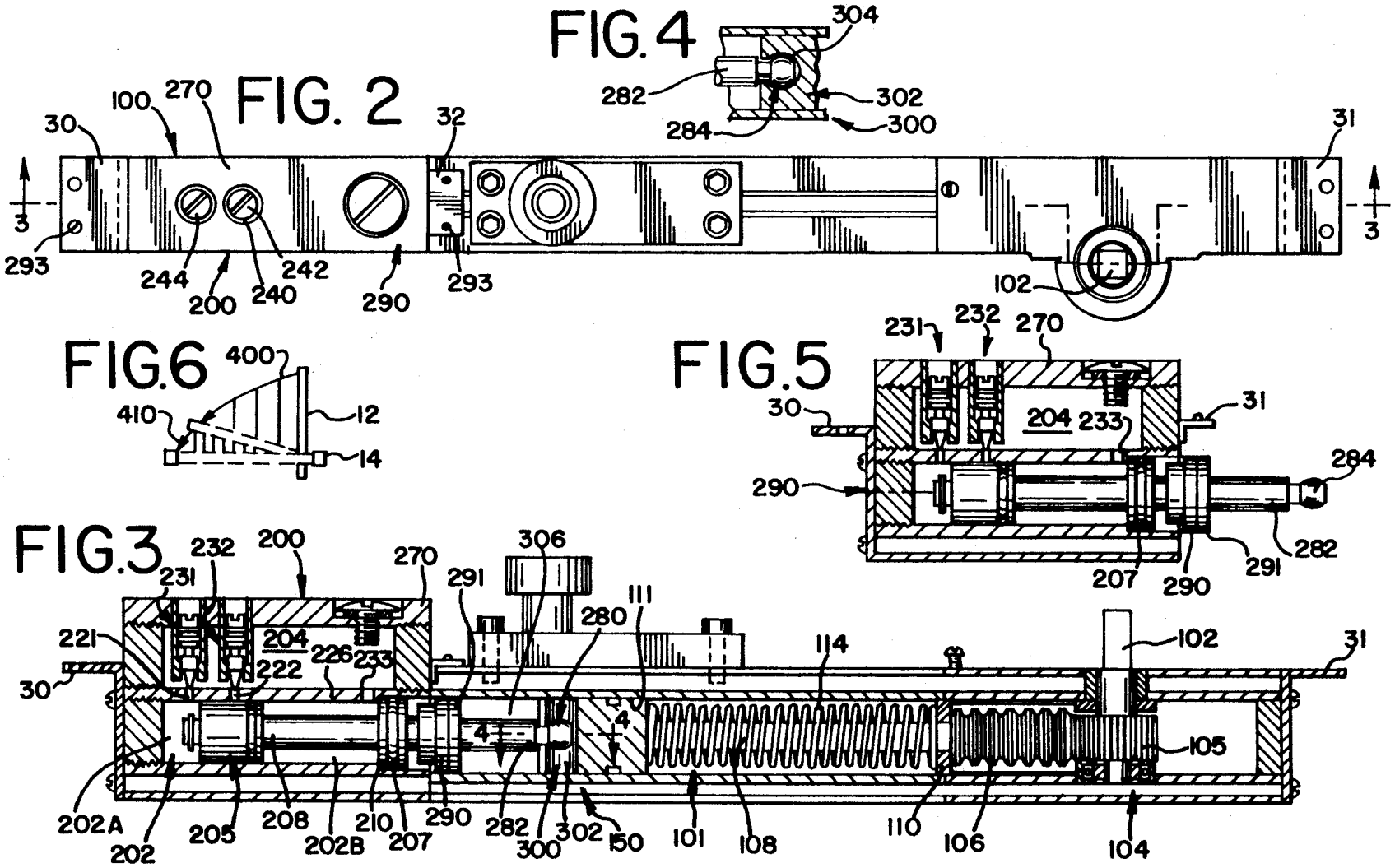
FIG. 2 is an enlarged sectional view of a top rail portion of the door illustrated in FIG. 1 showing the interconnection between the door, the door control apparatus and the door frame.
FIG. 3 is a sectional view of a door control apparatus of FIG. 2 taken along lines 3—3 thereof.
FIG. 4 is an enlarged view of the releasable connection between the hydraulic damping assembly and the spring closing assembly of the combined door control apparatus of FIG. 3.
FIG. 5 is a sectional view of the damping assembly as removed from the apparatus; and, FIG. 6 is a diagrammatic view of the closing cycle of the door control apparatus of FIG. 1.

As a result of the size and arrangement of its components and as illustrated in FIG. 1, the door control apparatus 100 may be disposed within a channel 22 located in the top door rail 16 and held in place therein by one or more attachment means, such as clips 30, 31. Alternatively, the door control apparatus 100 may also be located within the door header 13 of the door frame 14 or it may also be located on any convenient exterior surface of the top rail 16 of the door 12. As best seen in FIGS. 1 and 3, the door control apparatus 100 includes a rotatable post, or shaft 102, which engages a pivot arm 24 extending out from and connected to the door frame 14. A second pivot arm 25 interconnects the door 12 with the door frame 14 at the bottom rail portion 17.

The door control apparatus 100 includes a conventional rack gear assembly generally indicated as 104, in which a vertical pinion gear 105 engages a rack gear 106 which is capable of movement within a portion 152 of a spring assembly housing 150. The pinion gear 105 is connected to the shaft 102. Rotation of the shaft 102 is translated by the rack gear 106 into linear movement during opening and closing cycles of the door. As seen in FIG. 3, the rack member 106 is connected to an intermediate, or spring shaft 108, by any suitable means such as a threaded connection (not shown). The spring shaft 108 extends longitudinally within the spring assembly housing 150 between the rack gear assembly 104 and a hydraulic damping assembly 200 and operatively connects the two together.

The spring assembly 101 may use conventional components, such as a closing spring 114, disposed between rack assembly 104 and the hydraulic damping assembly 200. As best illustrated in FIG. 3, the spring 114 surrounds the spring shaft 108 and is retained within the spring assembly housing 150 between two opposing spring blocks 110, 111. The spring shaft 108 extends away from the rack gear 106 through a stationary spring block 110 and engages the opposing, moveable, spring block 111 in a suitable manner such as by a threaded connection, whereby when the door 12 opens, the rack gear 106 draws the spring shaft 108 rightward, and also draws spring block 111 rightward to compress the spring 114 between the spring blocks 110, 111. The movement of the spring shaft 108 also pulls on the piston 205 of damping assembly 200 causing it to displace rearwardly within the cylinder 202 (rightward in FIG. 3).

The door control apparatus 100 further includes a hydraulic assembly 200 operatively connected to the spring assembly 101 The hydraulic assembly 200 includes a cylinder 202 having a double-acting piston 205 slidable therein and a fluid reservoir 204. The piston 205 includes a conventional piston head 206 attached to a shaft 208 extending longitudinally within the cylinder 202. The shaft 208 extends outwardly from the cylinder 202 through a seal assembly 207 having one or more seal members 210 which provide a substantially fluid-tight seal between the shaft 208 and the cylinder end. Seal assembly 207 permits displacement of the piston shaft 208 in and out of the cylinder 202 in response to movement of the rack gear assembly 104 caused by opening and closing of the door 12.

The hydraulic assembly 200 may further preferably include at least two ports 221–222 extending through the cylinder wall 226 separating the cylinder 202 and reservoir 204 which define two separate cycles of the closing of the door 12. These ports 221, 222 have adjustable members in operative engagement therewith, such as needle valves 231–232, which permit the orifices of the ports 221, 222 to be adjusted to control the rate of transfer of fluid between the cylinder 202 and reservoir 204. Each needle valve 231, 232 has a valve stem 240 disposed in a sleeve 242, and the stem 240 extends upwardly through an end wall 270 of the fluid reservoir 204. The stem 240 includes a slot 244 which accommodates a screwdriver or other tool to permit the orifice size of the port to be adjusted from a point exterior of the damping assembly 200. The ports 221, 222 are preferably longitudinally aligned along an axis of the cylinder 202 in the path of travel of the piston 205 such that when the piston 205 moves within the cylinder 202 it contacts the ports 221, 222 (and seals them). This alignment defines two separate closing cycles for the door control apparatus 100. The cycles defined are a sweep 400 and a latch 410 cycle in which each cycle has a different respective door closing speed. (FIG. 6.)

The hydraulic assembly 200 defines two chambers 202A, 202B on opposite sides of the piston 205. The first chamber 202A lies in "front" of the piston 205 (left in FIG. 3) and the second chamber 202B lies "behind" the piston 205 (right in FIG. 3). Movement of the piston 205 within the cylinder 202 causes the displacement of hydraulic fluid from either chamber 202A or 202B into the reservoir 204 depending on the direction of travel of the piston 205. The separate latch and sweep subcycles of the closing of the door are best explained by a description of the operation of the door control apparatus. During opening, the spring shaft 108 is drawn by the rack gear 106 to the right of FIG. 3 and pulls the shaft 208 outwardly. Piston 205 thereby displaces fluid from chamber 202B into the reservoir through third port 223. When the opening force is released, and the door 12 closes, the spring 114 urges the spring shaft 108 leftward against the piston shaft 208, pushing the piston 205 into the cylinder. (FIG. 3.) The piston 205 displaces fluid from chamber 202A into the reservoir 204 initially through both ports 221–222. The closing movement of door is equal to the rate of displacement of fluid from chamber 202A to the reservoir 204 through both ports 221, 222. This rate is related to the total orifice area of both needle valves 231, 232. The door thus moves relatively rapidly through a sweep subcycle during closing.

As piston 205 moves further leftward, in the cylinder 202, it passes adjacent to port 222 and seals it. Fluid is only displaced from chamber 202A through the remaining port 221. This reduction of fluid transfer area, corresponds to a reduction in the rate of closure of the door 12. Thus, a second separate, or "latch" subcycle 410 is defined during closing in which the closing rate of the door is greatly reduced relative to the rate of the initial closing "sweep" subcycle 400. (FIG. 6) The rate of the closing sweep cycle and latch cycle may be regulated by adjusting the needle valves 231, 232. Both such closing cycles may therefore be easily adjusted to exert control over variables such as wind force, door size and opening force.

In another important aspect of the present invention, a reliable releasable connection 300 is provided between the hydraulic damping assembly 200 and the spring assembly 101. As shown best in FIGS. 3 and 4, this connection includes a receiving, or block member 302, having a suitable receptacle or cavity 304 disposed therein which positively and reliably engages and retains the piston shaft 208 therein. The piston shaft 208 preferably includes an engagement member 280 disposed at an outer end 282 thereof. As shown in FIGS. 3 and 5, the engagement member 280 may include a ball portion 284 sized to be received in the spring assembly cavity 304. The piston shaft 208 may further include one or more centering members such as bushings 290, 291 which are slidably received in a passage 306 of the spring assembly 101. These guide members may center the piston shaft 208 in proper orientation within the spring assembly passage 306 to ensure proper mating and engagement between the piston shaft 206 and the receiving block 302.

This connection 300 permits the door control apparatus 100 to have a modular nature, that is, the hydraulic damping assembly 200 may be advantageously constructed as a self-contained, integral unit 290 which may be easily removed from or inserted into reliable operative engagement with the spring assembly without the need for replacement or removal of the entire door operator 100. As such, in instances where the hydraulic damping assembly 200 fails, only the damping unit 290 need be replaced, while permitting the remaining door operator components to be used. In this regard, the damping unit 290 may have its cylinder 202 and reservoir 204 constructed out of a single piece of metal, such as aluminum. The unit 290 is preferably held in place within the door channel 22 by suitable attachment means, such as removable clips 30, 32 which are attached respectively to the door rail member 16 and the spring assembly by threaded fasteners 293. The seal assembly 207 may also utilize a conventional retaining member (not shown) such as a cylinder shoulder or snap ring to return it in place within the damping assembly unit 290 during operation of the door operator and insertion and removal of the unit 290.

It will be seen that while certain embodiments of the present invention have been shown and described it will be obvious to those skilled in the art that changes and modifications may be made therein without departing from the true spirit and scope of the invention.

I claim:

1. A modular door control apparatus for regulating movement of a door hingedly connected to a door frame, the apparatus comprising:

a spring assembly for applying a force to the door to move said door in a first preselected direction, a fluid damping assembly for applying a force to the spring assembly partially opposing the spring assembly force applied to said door, said spring assembly being contained within a first housing and retained therein between two spaced-apart opposing spring blocks and said damping assembly being contained within a second housing, said damping assembly including a piston slidably disposed in a cylinder, the cylinder being disposed within said second housing, said piston including a piston rod, the piston rod having a portion extending out of said second housing, said piston rod including an engagement element disposed on one end thereof, one of said spring assembly two spring blocks including a receptacle adapted to selectively releasably engage the engagement element, said first and second housings being interconnected at a quick release connection, whereby said damping assembly may be removed from said apparatus as a single unit, said quick release connection including a ball and socket connection, said piston rod engagement element including a ball portion and said spring block receptacle including a socket portion, said ball operatively engaging said socket and being removable therefrom by application of manually applied force to said damping assembly.

2. The apparatus of claim 1, wherein said second housing includes a fluid reservoir, the reservoir having a plurality of ports in fluid transfer communication with said cylinder, at least two of said ports having adjustable valve members in operative engagement therewith, the valve members each including a needle valve, the needle valve having an adjustment surface which is accessible from exterior of said second housing.

3. The apparatus of claim 1, wherein said first and second housings are dimensioned to fit within a top rail member of said door.

4. The apparatus of claim 3, wherein said second housing is attached at one end thereof to said door top rail member and is attached at an opposing end thereof to said spring assembly.

5. The apparatus of claim 1, wherein said spring assembly includes a spring retained between said two opposing spring blocks disposed in said first housing, one of said two spring blocks being held in place within said first housing the other of said two spring blocks being slidable within said first housing, said other spring block including means for releasably engaging said piston rod of said damping assembly.

6. A modular door operator for hydraulically regulating the closing of a door hingedly mounted within a door frame, the door being closeable by the operator, said operator comprising: spring means for applying a preselected closing force to said door, the spring means being operatively connected to a rotatable post, the post being operatively connected to the door frame, said spring means being disposed within a first housing member, damping means for applying a selectively adjustable damping force to said door during the closing thereof, the damping means being disposed within a second housing member, the second housing member adjoining the first housing member, the damping means being selectively releasably connected to said spring means, said damping means including a fluid-filled cylinder having a double acting piston therein, said cylinder being disposed within said second housing, said piston further having a shaft member extending out of said second housing into said first housing and into releasable connection with said spring means, said damping means including ball means disposed on said piston shaft member, and said spring means includes socket means disposed in a passage of said first housing, said ball means being releasably engaged by said socket means when said first housing adjoins said second housing.

7. The modular door operator of claim 6, wherein said spring means includes a rack and pinion gear assembly for translating rotational movement of said door into linear movement of a spring shaft.

8. The modular door operator of claim 6, wherein said first and second housing members are disposed within a channel portion of a rail member of said door, said first housing member including attachment means for attaching said first housing member to said door rail member and said second housing member.

9. The modular door operator of claim 6, wherein said cylinder is disposed within said second housing member adjacent a fluid reservoir, the reservoir communicating with said cylinder through a plurality of fluid transfer ports, at least two of said ports having adjustable valve members disposed therein, said adjustable valve members being accessible from exterior of said second housing member.

10. A quick release connection for releasably connecting together two components of a door closer, the door closer being received within a housing, said door closer controlling at least the closing of a door mounted within a door frame, said two components including a hydraulic component and a spring component, said connection comprising:

a connector element receptacle member adjoining the spring component such that the receptacle member slides within the door closer housing in response to movement of the door, the hydraulic component being disposed within a first subhousing of said door closer, the receptacle member having a cavity in the form of a socket portion which receives a connector element having a ball portion extending outwardly from the first subhousing and from an end of said hydraulic component, whereby said hydraulic component is quickly releasable from said spring component and said first subhousing is removable from said door closer by removal of said connector element from said receptacle member cavity, and whereby said hydraulic component is further attachable to said spring component and securable to said door closer.

11. The quick release connection according to claim 10, wherein said spring component is contained within a second subhousing, said hydraulic component including removable retaining means to facilitate access to said connection.

12. The quick release connection according to claim 11, wherein said door closer housing is received within a space formed within a rail portion of the door.

13. The quick release connection according to claim 11, wherein said door closer housing is dimensioned to be fitted adjacent to an upper horizontal edge of said door and such that said removable retaining means is accessible from above said upper horizontal edge.

14. The quick release connection according to claim 10, wherein said receptacle member is connected to a spring shaft of the spring assembly, said spring shaft being structured to move in response to the opening and the closing of said door.

15. The quick release connection according to claim 10, wherein said door closer housing is disposed proximate to a rail portion of said door.

16. A modular door control apparatus for regulating movement of a door hingedly connected to a door frame, the apparatus comprising:

a spring assembly for applying a force to the door to move said door in a first preselected direction, a fluid damping assembly for applying a force to the spring assembly partially opposing the spring assembly force applied to said door, said spring assembly being contained within a first housing and said damping assembly being contained within a second housing, said first and second housings being releasably interconnected, whereby said damping assembly may be removed from said apparatus as a single unit, said fluid damping assembly including a ball portion and said spring assembly including a socket portion, said fluid damping assembly ball portion operatively engaging said spring assembly socket portion and being removable therefrom by application of manually applied force to said damping assembly.

* * * * *